US011664609B2

(12) United States Patent
Tuerkekoele et al.

(10) Patent No.: US 11,664,609 B2
(45) Date of Patent: May 30, 2023

(54) CONDUCTOR TERMINAL

(71) Applicant: WAGO Verwaltungsgesellschaft mbH, Minden (DE)

(72) Inventors: Muhammet Ali Tuerkekoele, Minden (DE); Joerg Ahldag, Rinteln (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 89 days.

(21) Appl. No.: 17/384,162

(22) Filed: Jul. 23, 2021

(65) Prior Publication Data

US 2022/0029315 A1 Jan. 27, 2022

(30) Foreign Application Priority Data

Jul. 24, 2020 (DE) ..... 20 2020 104 276.9

(51) Int. Cl.
*H01R 4/48* (2006.01)
*H01R 9/24* (2006.01)

(52) U.S. Cl.
CPC ..... *H01R 4/4836* (2013.01); *H01R 4/4827* (2013.01); *H01R 9/2416* (2013.01)

(58) Field of Classification Search
CPC ... H01R 4/4836; H01R 4/4827; H01R 9/2416
See application file for complete search history.

(56) References Cited

U.S. PATENT DOCUMENTS 5,685,735 A 11/1997 Hohorst
7,249,963 B2 * 7/2007 Ramm ..... H01R 4/4836 439/437
7,896,685 B2 * 3/2011 Eppe ..... H01H 71/08 439/441
10,103,482 B2 * 10/2018 Stuckmann ..... H01R 13/6272

FOREIGN PATENT DOCUMENTS

DE 29500614 U1 3/1995

* cited by examiner

*Primary Examiner* — Oscar C Jimenez
*Assistant Examiner* — Paul D Baillargeon
(74) *Attorney, Agent, or Firm* — Muncy, Geissler, Olds & Lowe, P.C.

(57) ABSTRACT

A conductor terminal, including an insulating housing, the insulating housing having a conductor insertion opening for inserting an electrical conductor in a conductor insertion direction, including a busbar and including a clamping spring, the clamping spring having a contact leg for contact with a part of the conductor terminal, the contact leg transitioning into a spring bend, and the spring bend transitioning into a clamping leg, the clamping leg forming a clamping point with the busbar for the electrical conductor, and including an actuating element, the actuating element being configured to open the clamping point, the actuating element being able to be transferred from an initial position into an actuating position, and the clamping point being opened in the actuating position.

20 Claims, 6 Drawing Sheets

CONDUCTOR TERMINAL

This nonprovisional application claims priority under 35 U.S.C. § 119(a) to German Patent Application No. 20 2020 104 276.9, which was filed in Germany on Jul. 24, 2020 and which is herein incorporated by reference.

BACKGROUND OF THE INVENTION

Field of the Invention

The present invention relates to a conductor terminal, including an insulating housing, the insulating housing having a conductor insertion opening for inserting an electrical conductor in a conductor insertion direction, including a busbar and including a clamping spring, the clamping spring having a contact leg for contact with a part of the conductor terminal, the contact leg transitioning into a spring bend, and the spring bend transitioning into a clamping leg, the clamping leg forming a clamping point with the busbar for the electrical conductor, and including an actuating element, the actuating element being configured to open the clamping point, the actuating element being able to be transferred from an initial position into an actuating position, and the clamping point being opened in the actuating position.

Description of the Background Art

A conductor terminal of this type is known from DE 295 00 614 U1, which corresponds to U.S. Pat. No. 5,685,735, which is incorporated herein by reference.

SUMMARY OF THE INVENTION

It is therefore an object of the present invention to further improve a conductor terminal of this type with respect to its functionality.

This object is achieved in the case of a conductor terminal of the type mentioned at the outset in that a restoring spring element is arranged on the side of the contact leg facing away from the clamping point, the restoring spring element being designed to move the actuating element from a position between the initial position and the actuating position to the initial position or from the actuating position to the initial position. The invention has the advantage that the actuating element is always restored to its initial position, due to the restoring effect of the restoring spring element, when a manual actuating force is no longer applied thereto and a possibly present engagement is released. The return to the initial position is ensured independently of whether an electrical conductor is clamped in the conductor terminal, or what cross section this terminal has. Unlike conductor terminals from the prior art, in which no restoring spring element of this type is present, but instead a restoration of the actuating element takes place at best due to the force of the clamping spring, in the case of the present invention, the restoring function is decoupled from a possible present restoring effect of the clamping spring, due to the additional restoring spring element. For example, if an electrical conductor having a correspondingly large cross section is clamping at the clamping point, the clamping spring may at best effectuate a short restoring travel of the actuating element, which is generally not sufficient to return it to the initial position. Due to the restoring spring element present in addition to the clamping spring, the actuating element may nevertheless be moved all the way back to its initial position.

In the case of the conductor terminal according to the invention, however, the actuating element may be loaded by a restoring force of the clamping spring active in the direction of the initial position in certain positions, at least in the actuating position.

By arranging the restoring spring element on the side of the contact leg facing away from the clamping point, it may be accommodated in a very space-saving manner, so that it is possible to provide the conductor terminal with an overall highly compact and small-sized design. The restoring spring element may also be particularly easily formed during manufacturing as a single piece with the actuating element.

In particular, the conductor terminal may be designed in such a way that the clamping point is formed between the clamping leg and the busbar, e.g. in such a way that the clamping point is the point at which the conductor adjoins the busbar, on the one hand, and adjoins the clamping leg, on the other hand, and is clamped firmly in place. If the clamping leg has a clamping edge on its free end, the clamping edge then adjoins the electrical conductor. The clamping effect of the conductor terminal may be further increased by the clamping edge.

The restoring spring element is elastically deformable for generating a restoring spring force. The restoring spring element may be advantageously designed as a pressure spring, which applies a pressure force to the actuating element, which is active in the direction of the initial position. The active direction of the restoring spring force of the restoring spring element does not necessarily have to run exactly in parallel to the direction of movement of the actuating element, but certain angle deviations are also possible, for example in the range of +/−45 degrees.

The actuating position is, as mentioned above, the position of the actuating element in which the clamping point is opened (open position of the clamping point). In this open position, the clamping leg is deflected directly or indirectly via the actuating element and moves away from the busbar, so that an electrical conductor may be inserted into the clamping point or removed therefrom without the application of force.

The initial position of the actuating element may be, for example, a position in which the clamping spring or the clamping leg is not actuated by the actuating element and is therefore not deflected. In the initial position, the actuating element may touch the clamping spring or the clamping leg but not apply force thereto in such a way that the latter is deflected. The clamping point is then closed (closed position of the clamping point).

The actuating element may also assume other positions, for example intermediate positions between the actuating position and the initial position, or positions beyond the actuating position and/or beyond the initial position.

The actuating element may be designed, for example, as an actuating pushbutton, which is actuated by an application of pressure by the user. The actuating element may have a manual actuating section for this purpose. The manual actuating section may protrude, for example, out of the insulating housing in the initial position, so that it may be comfortably actuated manually even without a tool. The actuating element may be movably supported in the insulating material housing, for example movable in a mainly linear manner. When moving from the initial position into the actuating position and back again, the actuating element carries out a mainly linear movement.

As mentioned above, the restoring spring element is arranged on the side of the contact leg facing away from the clamping point. This also includes, in particular, areas in the elongation of the contact leg. The restoring spring element may thus be arranged in an entirely or partially overlapping manner with the contact leg, or it may have no overlap. The restoring spring element may thus also be arranged on the side of the imaginary elongation of the contact leg facing away from the clamping point, in particular in a longitudinal extension direction of the contact leg. In one advantageous embodiment of the invention, the distance between the clamping point and the restoring spring element is greater than the distance between the clamping point and the contact leg.

According to one advantageous embodiment of the invention, it is provided that the actuating element has an actuating section, the actuating section interacting with the clamping leg of the clamping spring in such a way that the actuating section is configured to open the clamping point. The actuating section may act upon the clamping leg indirectly or directly via at least one other element. If the actuating element moves into the actuating position, the clamping leg of the clamping spring is deflected by the actuating section, so that the clamping point is ultimately opened. In addition to the actuating section, the actuating element may also have a connecting section and a manual actuating area. The manual actuating area is connected to the actuating section via the connecting section. The actuating element may furthermore have a restoring section, which is connected to the connecting section. The restoring spring element is then coupled with the restoring section, so that the restoring movement of the actuating element takes place by transmitting a pressure force from the restoring spring element into the restoring section.

The actuating element can encompass the spring bend of the clamping spring. In this way, the available installation space may be particularly efficiently utilized. The spring bend of the clamping spring may dip into a free space of the actuating element to a greater or lesser degree, depending on the position of the actuating element. The free space of the actuating element may be limited, for example by the restoring section, the connecting section and the actuating section. The actuating element may thus be provided with a U-shaped design in this area. The encompassing involves the fact that, for example, the actuating element is guided around the spring bend.

The restoring spring element and the actuating element can be formed from the same material. Alternatively, the restoring spring element and the actuating element may also be formed from different materials. For example, the actuating element may be formed from plastic and the restoring spring element from metal or plastic.

The restoring spring element can be formed as a single piece from a free end of the actuating element. This permits a particularly easy and cost-effective manufacturing of the actuating element with the restoring spring element. The assembly of the conductor terminal is also simplified. The restoring spring element may not become lost during assembly. For example, the restoring spring element may be formed as a single piece from a free end of the restoring section of the actuating element.

The restoring spring element can be provided with a meandering design. Alternatively, the restoring spring element may also be designed in any other shape of a pressure spring, e.g. in the manner of a spiral spring.

At least one engaging element can be arranged on the actuating element, the engaging element being configured to engage the actuating element in the initial position and/or the actuating position. This has the advantage that the actuating element is fixed in a defined manner at least in a defined position, i.e. the initial position and/or the actuating position. If the engagement takes place in the actuating position, the open position of the clamping point is retained even when the user has ended his manual application of pressure force of the actuating element. To return the actuating element from the actuating position into the initial position, the engagement must then be released, for example with the aid of a tool. For example, the engaging element may be deflected with the aid of the tool, and the engagement may be released hereby.

The engaging element can be configured to engage the actuating element with an engagement recess of the insulating housing. The engagement may be particularly easily and efficiently implemented in this manner. In addition, the release of the engagement may be easily and comfortably designed for the user, e.g. in that the engagement recess of the insulating housing passes through to the outer surface. The user may then actuating the engaging element through the engagement recess from the outside, using a tool, and thereby deflect it so that the engagement is released. If an engagement is desired in the initial position as well as in the actuating position, a separate engagement recess may be present on the insulating housing for the initial position and for the actuating element.

A guide contour can be arranged on the engaging element for guiding the engaging element into the engagement recess and/or out of the engagement recess. This permits an easy engagement and/or disengagement of the engaging element. The guide contour may be designed, for example, as a surface of the engaging element running at an angle with respect to the direction of movement of the actuating element.

The engaging element can be arranged on the actuating element on the side of the contact leg facing away from the clamping point. The engaging element is arranged hereby at an easily accessible point, so that the release of the engagement may be made easy and comfortable for the user.

According to an example of the invention, which, in combination with the conductor terminal mentioned at the outset, is also to be viewed as an independent invention, the actuating element is elastically deflectable at least in the area of the engaging element. In this way, the engagement may be easily released again by elastic deformation and therefore defection of the actuating element. For this purpose, the conductor terminal may have a free space on the side of the actuating element opposite the engaging element, into which the actuating element may be deflected.

The invention thus also relates to a conductor terminal, including an insulating housing, the insulating housing having a conductor insertion opening for inserting an electrical conductor in a conductor insertion direction, including a busbar and including a clamping spring, the clamping spring having a contact leg for contact with a part of the conductor terminal, the contact leg transitioning into a spring bend, and the spring bend transitioning into a clamping leg, the clamping leg forming a clamping point with the busbar for the electrical conductor, and including an actuating element, the actuating element being configured to open the clamping point, the actuating element being able to be transferred from an initial position into an actuating position, and the clamping point being opened in the actuating position, at least one engaging element being arranged on the actuating element, the engaging element being configured to engage the actuating element in the initial position and/or the actuating position, the actuating element being elastically deflectable at least in the area of the engaging element.

A securing clip can be arranged at the actuating element and/or at the contact leg, the securing clip holding the engaging element in the engagement recess at least in the actuating position of the actuating element. A holding force may thus be applied to the actuating element by the securing clip, at least in the area of the engaging element, by means of which the engaging element is pressed sufficiently far into the engagement recess.

A force may therefore be applied to the engaging element by the securing clip in a direction which faces away from the clamping point. The securing clip may be arranged on the side of the actuating element opposite the engaging element. The securing clip may extend into a free space between the engaging element and the contact leg.

At least one guide pin can be arranged on the conductor terminal for guiding the actuating element in the insulating housing. This permits a secure guidance of the movement of the actuating element. In particular, a tilting or catching is avoided.

At least two guide pins can be arranged on the actuating element, the guide pins being arranged on sides of the actuating element opposite each other, and the guide pins each being movably supported in a recess of the insulating housing.

The clamping spring can be provided with a V-shaped design. The clamping spring is fixed on a part of the conductor terminal by its contact leg and is thus immovably arranged in the insulating housing, at least in the area of the contact leg. The busbar may also be immovably arranged in the insulating housing. For example, the busbar may be part of a holding frame, in which the clamping spring is clamped. In this case, it is advantageous if the entire holding frame is immovably arranged in the insulating housing, i.e. fixed accordingly.

The actuating element can have an actuating section, the actuating section adjoining the clamping leg for opening the clamping point, and the actuating section protruding into the area of the clamping point, and the electrical conductor to be clamped being able to be guided to the clamping point next to the actuating section. This also permits a particularly compact structure of the conductor terminal. In addition, the actuating section may be reliably supported, and the forces necessary to deflect the clamping leg may be absorbed in this manner. The area of the clamping point may be, in particular, the side area next to the clamping point. However, the area of the clamping point also includes the area above the clamping point. An electrical conductor would thus be able to be guided through to the clamping point beneath the actuating section. The actuating section may thus have a U-shaped recess for the through-passage of the electrical conductor. It is conceivable that the actuating section has two oppositely situated side sections, the electrical conductor being able to be guided to the clamping point between the oppositely situated side sections.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein:

FIG. 3 shows the conductor terminal according to FIG. 1 with the electrical conductor clamped in.

DETAILED DESCRIPTION

Figure 1:
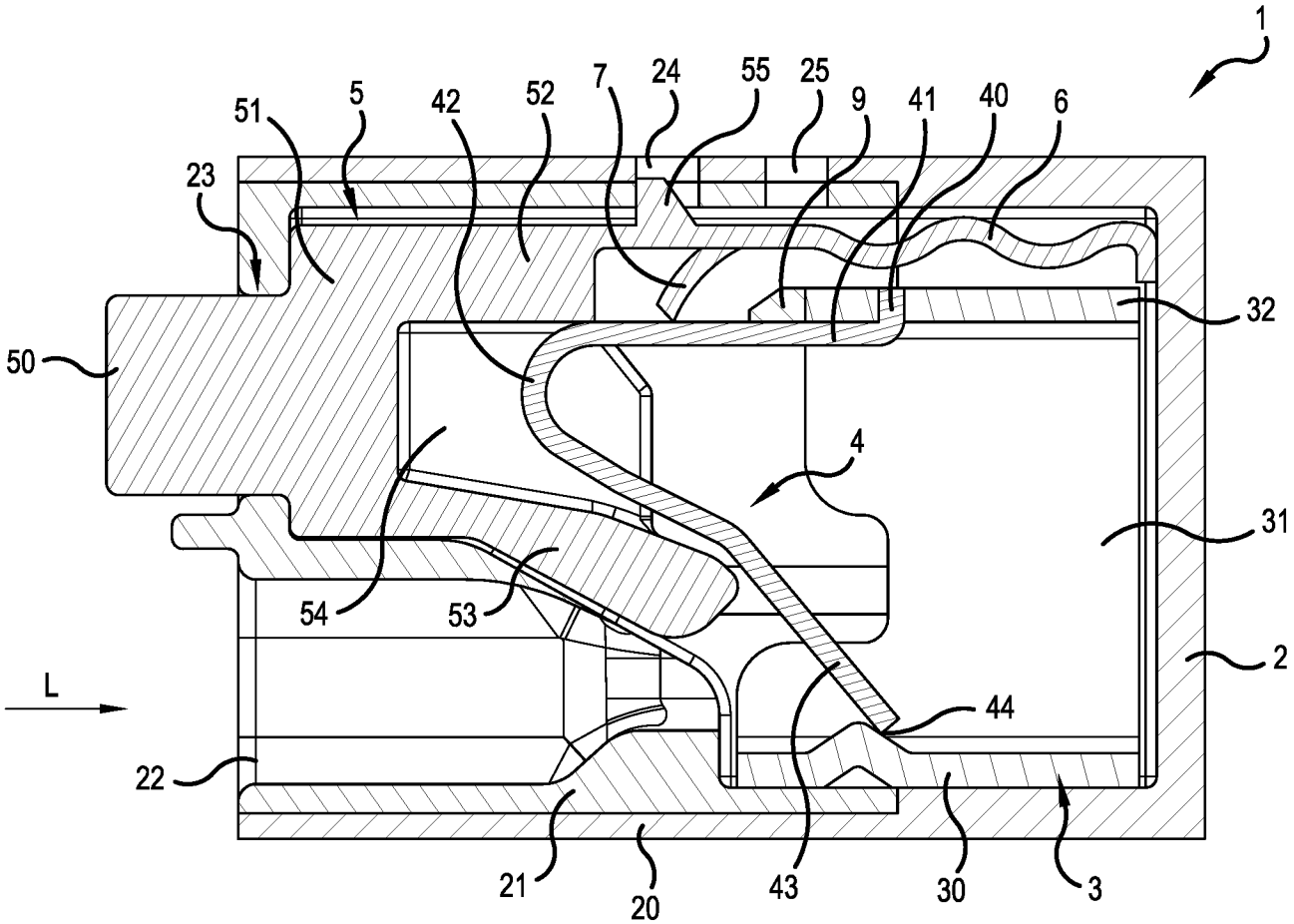
FIG. 1 shows an example of a conductor terminal in a side sectional view with an actuating element in the initial position.

FIG. 1 shows a conductor terminal 1, including an insulating housing 2. Insulating housing 2 may be have a two-part design, including a main housing part 20 and a closure part 21 insertable into main housing part 20. Such an at least two-part design of insulating housing 2 makes it easier to install the contact insert and further components into insulating housing 2.

Insulating housing 2 has a conductor insertion opening 22 for inserting an electrical conductor in a conductor insertion direction L. Conductor insertion opening 22 may be, for example, part of closure part 21. Insulating housing 2 further has an actuating opening 23, through which an actuation of an actuating element 5 may take place or through which actuating element 5 may extend. Actuating opening 23 may be, for example, part of closure part 21.

An electrical contact insert is installed in the interior of insulating housing 2, which includes a busbar 3 and a clamping spring 4. Busbar 3 has a contact section 30, on which an electrical conductor is to be clamped. Busbar 3 may be provided, for example, with a frame-shaped design in the manner of a holding frame, e.g. in that busbar 3 has a vertical section 31 and a support section 32 in addition to contact section 30. Vertical section 31 connects contact section 30 to support section 32. Vertical section 31 may be arranged essentially at right angles with respect to contact section 30. Support section 32 may be arranged essentially at right angles with respect to vertical section 31. A busbar 3 having a U-shaped cross-sectional contour thus results in cross section. Busbar 3 may be formed as a one-part metal component with contact section 30, vertical section 31 and support section 32.

Clamping spring 4 includes a contact leg 41, which is adjoined by a spring bend 42. A clamping leg 43 of clamping spring 4 adjoins spring bend 42. Clamping leg 43 ends at the free end with a clamping edge 44. Contact leg 41 is used to fix clamping spring 4 in insulating housing 2. For example, contact leg 41 may have a fixing clip 40, bent essentially at right angles, on the free end or at another point, with the aid of which contact leg 41 is suspended in a recess of busbar 3, e.g. a recess in support section 32.

Actuating element 5 has a manual actuating area 50, at which actuating element 5 may be actuated by the user applying manual pressure force. Actuating element 5 further has a connecting section 51, which connects manual actuating area 50 to a restoring section 52 of actuating element 5 on one side and to an actuating section 53 of actuating element 5 on the other side. A free space 54 is formed on actuating element 5 between restoring section 52, connecting section 51 and actuating section 53, in which at least a part of clamping spring 4, in particular spring bend 42, may be accommodated.

Restoring section 52 is used to restore actuating element 5 in the direction of the initial position. Restoring section 52 is connected to a restoring spring element 6 for this purpose. In the illustrated exemplary embodiment, restoring spring element 6 is formed as a single piece with restoring section 52. In this exemplary embodiment, restoring spring element 6 is designed as a wavy or meandering spring element. Restoring spring element 6 is supported on insulating housing 2 at its free end.

Actuating element 5 further includes a engaging element 55, by means of which actuating element 5 may be engaged in the initial position and/or the actuating position. Engaging element 55 may engage with one of two engagement recesses 24, 25 formed on insulating housing 2, depending on the position. In FIG. 1, engaging element 55 is engaged with a first engagement recess 24, which effectuates an engagement in the initial position of actuating element 5.

A securing clip 7 is further present, by means of which the engagement of engaging element 55 with one of engagement recesses 24, 25 is supported. In the exemplary embodiment illustrated here, securing clip 7 is formed as a single piece with actuating element 5 or restoring spring element 6. Securing clip 7 may be in a pretensioned state permanently or at least in certain positions of actuating element 5, e.g. in the actuating position. A force is transmitted by securing clip 7 to restoring section 52 and thus to engaging element 55, which faces away from the clamping point. Securing clip 7 may be supported, for example, on contact leg 41, but other possibilities for support are also conceivable, such as in a part of the insulating housing.

In the state illustrated in FIG. 1, in which no electrical conductor is clamped and actuating element 5 is in its initial position, clamping leg 43 adjoins contact section 30 of busbar 3. If actuating element 5 is pushed to the right by manually pressing on manual actuating area 50, actuating section 53 comes in contact with clamping leg 43 and deflects it, i.e. the free end of clamping leg 43 is moved away from contact section 30. If this movement continues until engaging element 55 reaches second engagement recess 25, engaging element 55 engages with second engagement recess 25. In this way, actuating element 5 is fixed in the actuating position by the engagement. Clamping leg 43 is thus permanently deflected in this actuating position. An engagement in the actuating position between second engagement recess 25 and engaging element 55 is optional and not absolutely mandatory.

If actuating element 5 is actuated in this way, the user must not only overcome the spring force of clamping spring 4 but also the restoring spring force of restoring spring element 6.

Figure 2:
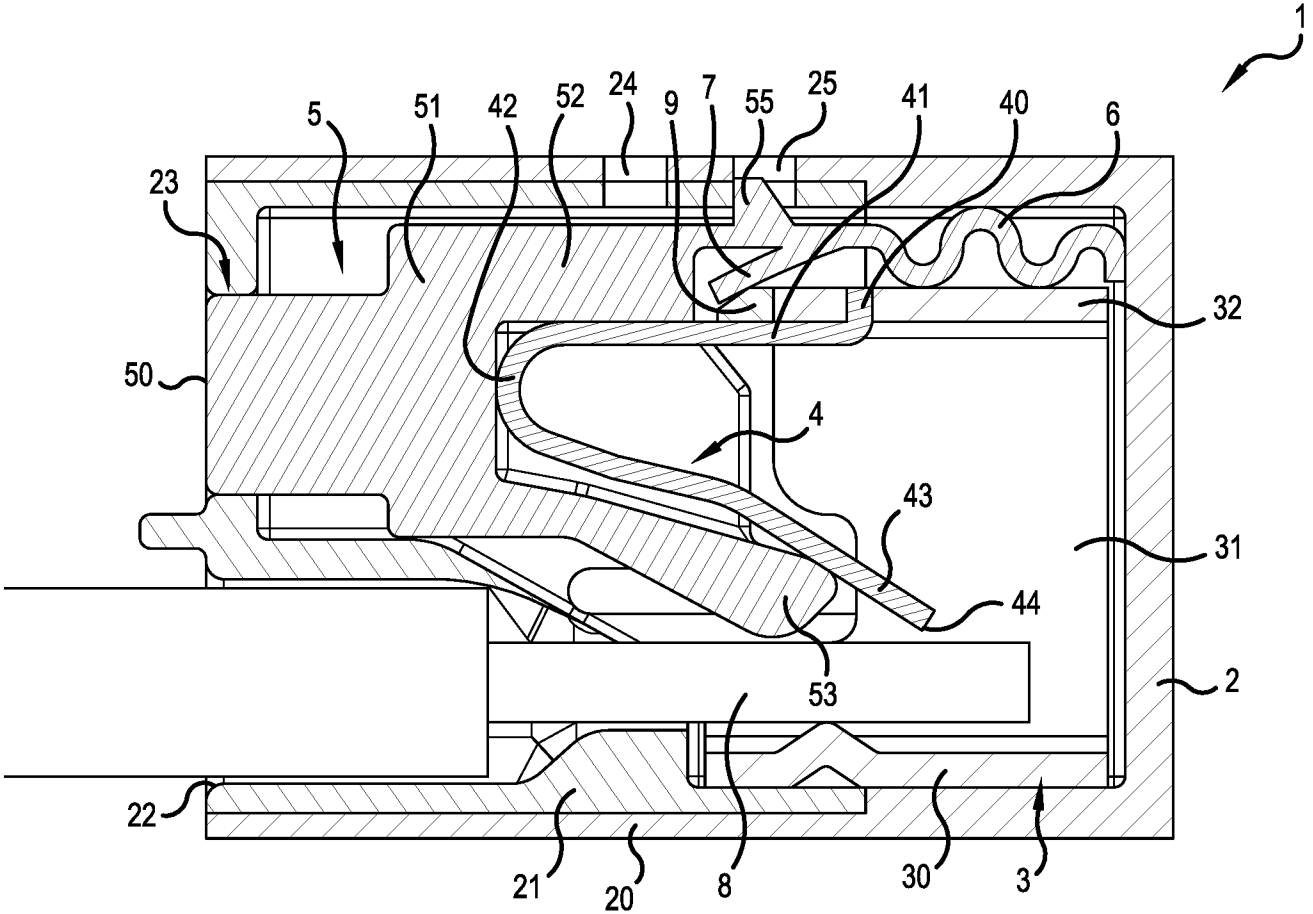
FIG. 2 shows the conductor terminal according to FIG. 1, with the actuating element in the actuating position.

If the actuating position is now reached, in which engaging element 55 engages with second engagement recess 25, the state illustrated in FIG. 2 results. In contrast to the representation in FIG. 1, it is apparent that restoring spring element 6 is compressed. Clamping leg 43 of clamping spring 4 is greatly deflected. An electrical conductor 8 is inserted up to the clamping point. Since actuating element 5 has not yet been released from its actuating position, clamping leg 43 does not yet touch electrical conductor 8.

As is apparent, securing clip 7 reaches a pretensioning element 9 in the area of the actuating position, which may have, for example a ramp-shaped contour. Due to pretensioning element 9, on which securing clip 7 is supported in the actuating position, securing clip 7 is additionally pretensioned, so that it transmits a greater force onto engaging element 55. Engaging element 55 is particularly securely engaged hereby in actuating position. Pretensioning element 9 may be formed, for example as a single piece, on closure element 21.

Figure 3:
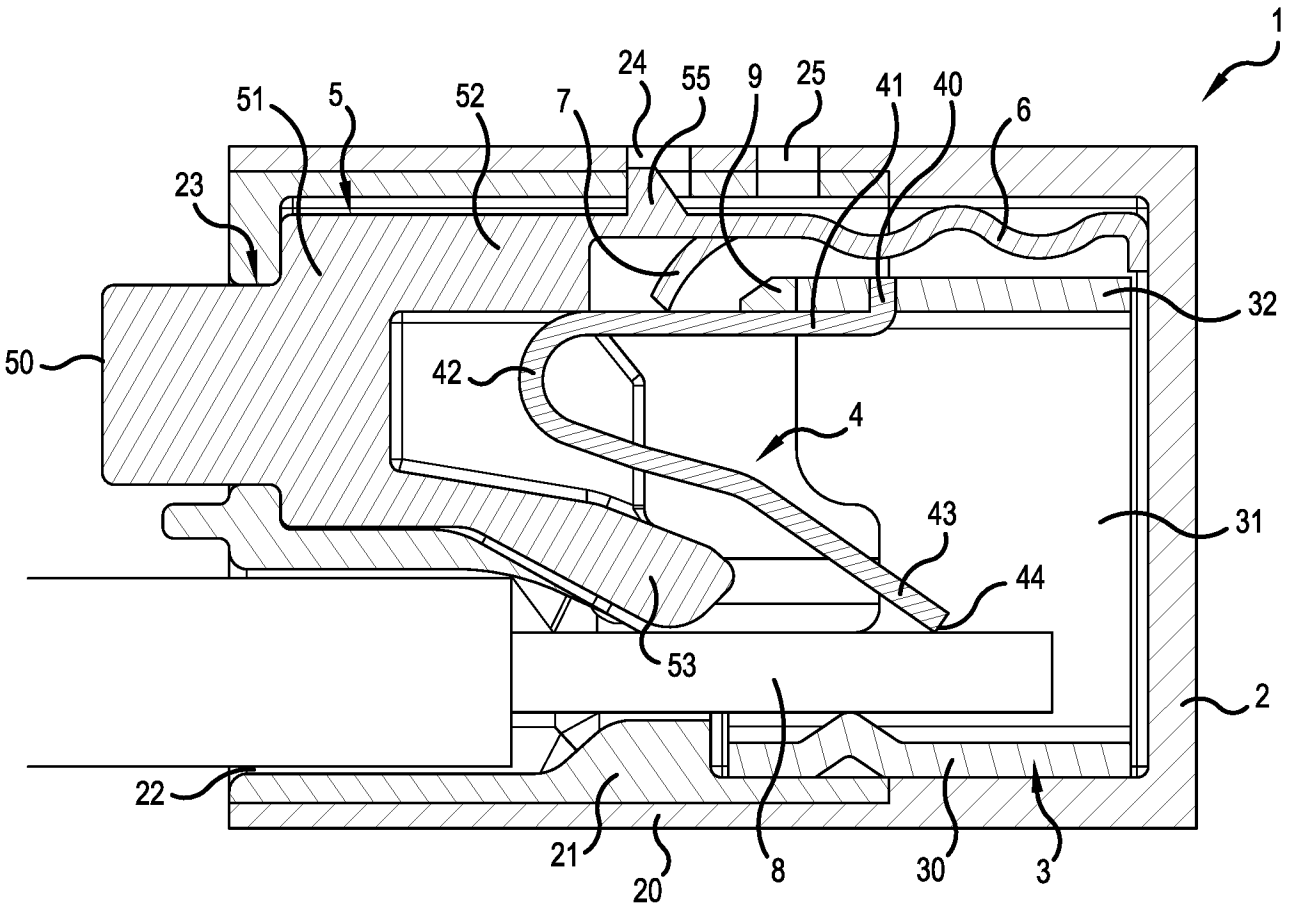

FIG. 3 shows conductor terminal 1, including clamped-on electrical conductor 8, the engagement of actuating element 5 in the actuating position being released. The release of the actuating position preferably takes place by an application of force onto the engaging element from outside conductor terminal 1. Actuating element 5 is moved back into its initial position by the restoring spring force of restoring spring element 6. Engaging element 55 is now again engaged with first engagement recess 24. Actuating section 53 now no longer touches clamping leg 43. Clamping leg 43 now adjoins electrical conductor 8 with its free end and clamps the latter firmly against the clamping point.

Figure 4:
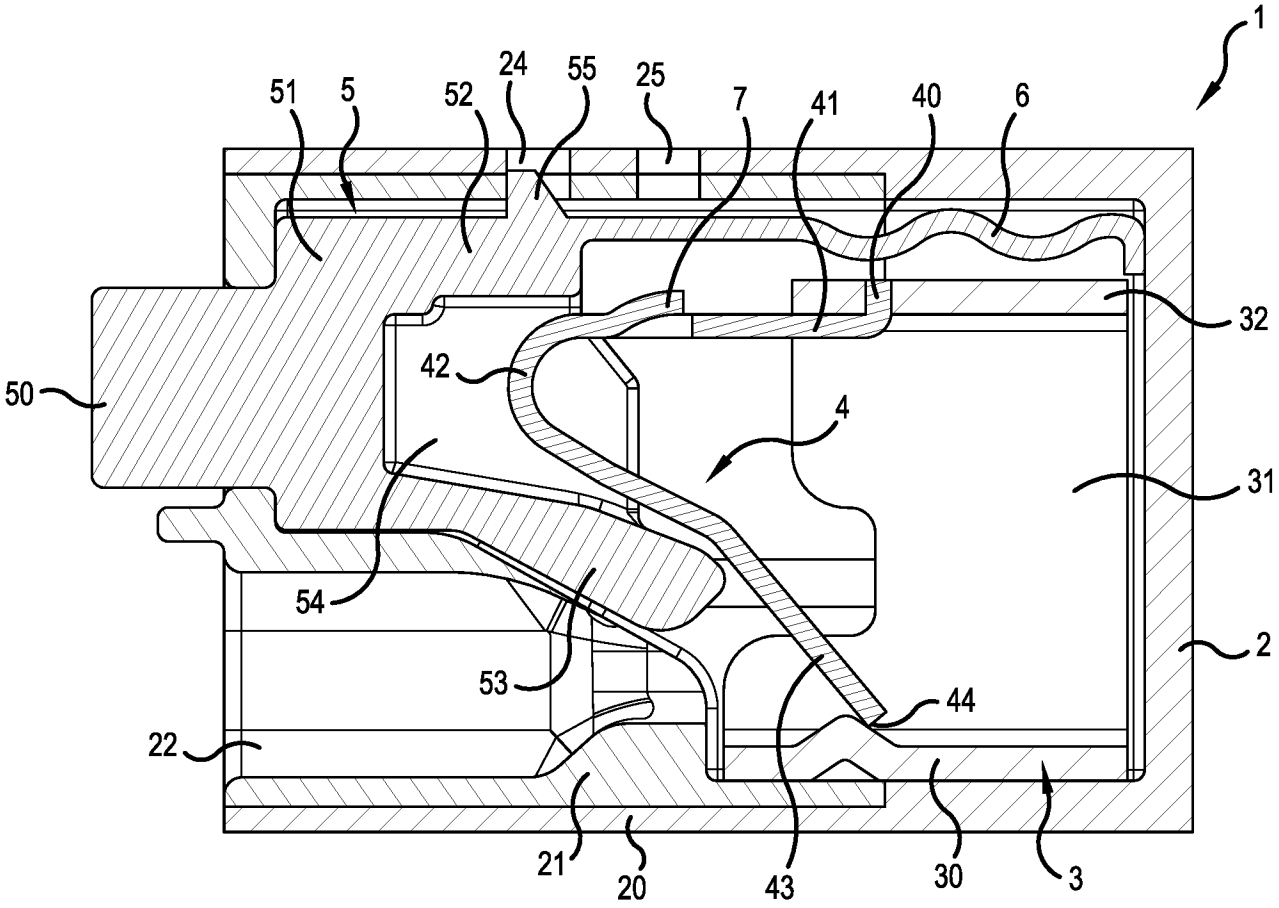
FIG. 4 shows an example of a conductor terminal in a side sectional view.

FIG. 4 shows a conductor terminal, which corresponds to the specific embodiment described above, except for the design of securing clip 7. In contrast to the specific embodiment in FIGS. 1 through 3, securing clip 7 is now designed not as an element arranged on actuating element 5 or on restoring spring element 6 but instead as an element formed on contact leg 41 of clamping spring 4. For example, securing clip 7 may be designed as a clip formed out of the material of contact leg 41. Securing clip 7 in this case is always fixedly situated at a position below second engagement recess 25. If actuating element 5 is moved into the actuating position, restoring section 52 comes into contact with securing clip 7 and is pressed upward in the area of engaging element 55, i.e. in a direction which faces away from the clamping point. Otherwise, the functionality of conductor terminal 1 according to FIG. 4 is comparable to the functionality described above.

Figure 5:
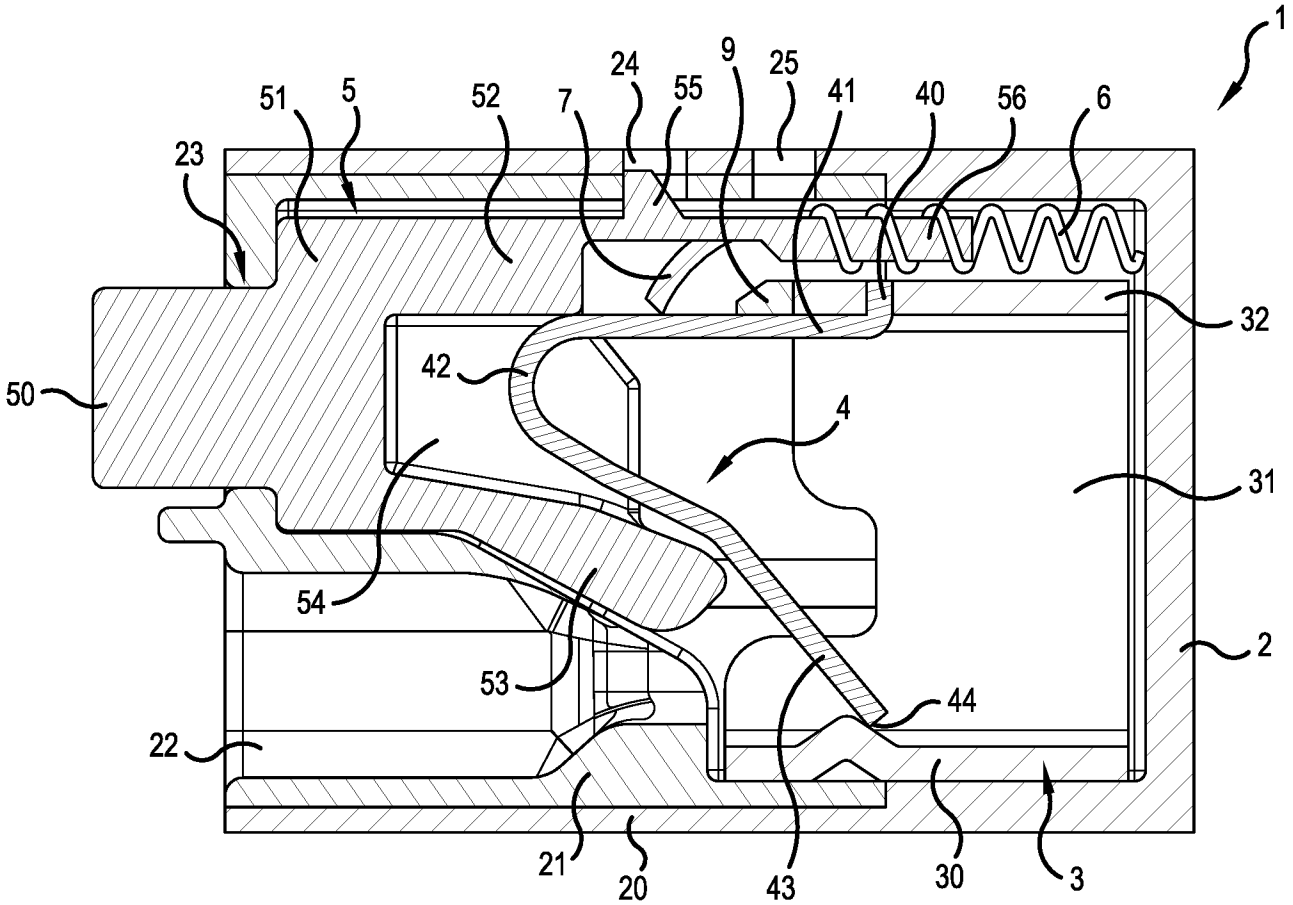
FIG. 5 shows an example of a conductor terminal in a side sectional view.

FIG. 5 shows a further specific embodiment of a conductor terminal 1, in which restoring spring element 6 is designed as a separate component, e.g. as a spiral spring. Conductor terminal 1 according to FIG. 5 otherwise corresponds to the design in FIGS. 1 through 3, but could also be combined with the specific embodiment in FIG. 4 (other arrangement of securing clip 7). Restoring section 52 of actuating element 5 now has an elongated extension 56, to which restoring spring element 6 is fastened. Extension 56 is used to guide and stabilize restoring spring element 6 as the spring force increases when actuating element 5 is moved into the actuating position.

Figure 6:
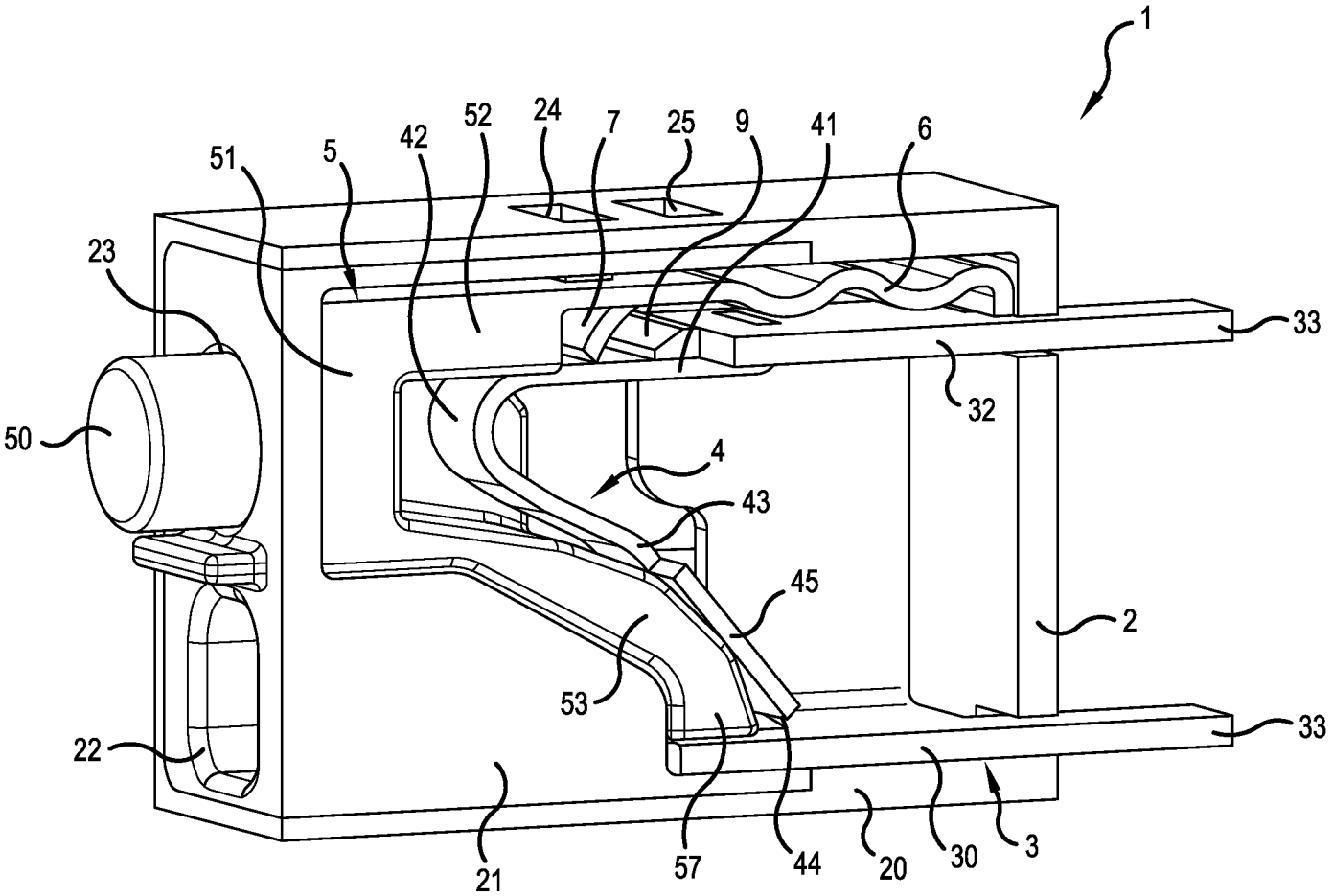
FIG. 6 shows the conductor terminal according to FIG. 1 in a in a perspective view with the housing open on the side.

FIG. 6 shows the design of actuating section 53 of actuating element 5 as an example, applicable to all specific embodiments described above. Actuating section 53 may be provided with a U-shaped design in the direction of its free end and have particular oppositely situated side sections 57. A free space is formed between side sections 57, through which electrical conductor 8 may be inserted up to the clamping point. Side sections 57 are simultaneously used to bear and support actuating section 53 on busbar 3, in particular on contact section 30. Side sections 57 slide along contact section 30 during an actuation of actuating element 5.

As is further apparent, clamping leg 43 may be provided with a widened design on one side or on both sides in the area in which it is in contact with actuating section 53. These widened sections 45 come into contact with actuating section 53 when actuating element 5 is moved into the actuating position.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A conductor terminal comprising:

an insulating housing having a conductor insertion opening for inserting an electrical conductor in a conductor insertion direction;

a busbar;

a clamping spring having a contact leg for contact with a part of the conductor terminal, the contact leg transitioning into a spring bend, and the spring bend transitioning into a clamping leg, the clamping leg forming a clamping point with the busbar for the electrical conductor;

an actuating element configured to open the clamping point, the actuating element adapted to be transferred from an initial position into an actuating position, and the clamping point being opened in the actuating position; and a restoring spring element arranged on a side of the contact leg facing away from the clamping point, the restoring spring element configured to move the actuating element from a position between the initial position and the actuating position to the initial position or from the actuating position to the initial position.

2. The conductor terminal according to claim 1, wherein the restoring spring element is configured to displace the actuating element.

3. The conductor terminal according to claim 1, wherein the actuating element has an actuating section, the actuating section interacting with the clamping leg of the clamping spring such that the actuating section is configured to open the clamping point.

4. The conductor terminal according to claim 3, wherein the actuating element encompasses the spring bend of the clamping spring.

5. The conductor terminal according to claim 1, wherein the restoring spring element and the actuating element are formed from the same material.

6. The conductor terminal according to claim 1, wherein the restoring spring element is formed as a single piece from a free end of the actuating element.

7. The conductor terminal according to claim 1, wherein the restoring spring element is provided with a meandering design.

8. The conductor terminal according to claim 1, wherein at least one engaging element is arranged on the actuating element, the engaging element being configured to engage the actuating element in the initial position and/or the actuating position.

9. The conductor terminal according to claim 8, wherein the engaging element is configured to engage the actuating element with an engagement recess of the insulating housing.

10. The conductor terminal according to claim 9, wherein a securing clip is arranged on the actuating element and/or on the contact leg, the securing clip holding the engaging element in the engagement recess at least in the actuating position of the actuating element.

11. The conductor terminal according to claim 10, wherein a force is adapted to be applied to the engaging element by the securing clip in a direction which faces away from the clamping point.

12. The conductor terminal according to claim 10, wherein the securing clip is arranged on a side of the actuating element opposite the engaging element.

13. The conductor terminal according to claim 10, wherein the securing clip extends into a free space between the engaging element and the contact leg.

14. The conductor terminal according to claim 8, wherein a guide contour is arranged on the engaging element for guiding the engaging element into the engagement recess and/or out of the engagement recess.

15. The conductor terminal according to claim 8, wherein the engaging element is arranged on the actuating element on a side that faces away from the clamping point.

16. The conductor terminal according to claim 1, wherein at least one guide pin is arranged on the conductor terminal for guiding the actuating element in the insulating housing.

17. The conductor terminal according to claim 16, wherein at least two guide pins are arranged on the actuating element, the guide pins being arranged on sides of the actuating element situated opposite each other, and the guide pins each being movably supported in a recess of the insulating housing.

18. The conductor terminal according to claim 1, wherein the clamping spring is provided with a V-shaped design.

19. The conductor terminal according to claim 1, wherein the actuating element has an actuating section, the actuating section adjoining the clamping leg for opening the clamping point, and the actuating section protruding into the area of the clamping point, and the electrical conductor to be clamped being able to be guided to the clamping point next to the actuating section.

20. A conductor terminal comprising:

an insulating housing having a conductor insertion opening for inserting an electrical conductor in a conductor insertion direction;

a busbar;

a clamping spring having a contact leg for contact with a part of the conductor terminal, the contact leg transitioning into a spring bend, and the spring bend transitioning into a clamping leg, the clamping leg forming a clamping point with the busbar for the electrical conductor;

an actuating element configured to open the clamping point, the actuating element adapted to be transferred from an initial position into an actuating position, and the clamping point being opened in the actuating position; and a restoring spring element arranged on a side of the contact leg facing away from the clamping point, the restoring spring element configured to move the actuating element from a position between the initial position and the actuating position to the initial position or from the actuating position to the initial position, wherein at least one engaging element is arranged on the actuating element, the engaging element being configured to engage the actuating element in the initial position and/or the actuating position, and wherein the engaging element is movable to engage with a first engagement recess of the insulating housing in the initial position and engage with a second engagement recess of the insulating housing in the actuating position.

* * * * *